United States Patent [19]

Porta et al.

[11] Patent Number: 4,699,445

[45] Date of Patent: Oct. 13, 1987

[54] ELECTRICAL TERMINAL ASSEMBLY FOR THERMISTORS

[75] Inventors: Gary D. Porta, New Cumberland; Terry L. Shutter, York, both of Pa.

[73] Assignee: AMP Incorporated, Harrisburg, Pa.

[21] Appl. No.: 890,202

[22] Filed: Jul. 28, 1986

[51] Int. Cl.[4] ..... H01R 13/11; H01R 13/66

[52] U.S. Cl. ..... 439/698; 439/620; 439/830

[58] Field of Search ..... 339/17 LC, 17 C, 147 R, 339/147 P, 256 C, 256 SP, 258 R, 258 P, 258 F, 258 RR, 258 S; 374/208

[56] References Cited

U.S. PATENT DOCUMENTS 2,962,692 11/1960 White ..... 339/17 LC
2,997,685 8/1961 Anderson ..... 339/258 S
4,163,146 7/1979 Meywald ..... 339/258 R
4,293,890 10/1981 Varsane ..... 339/258 P
4,530,553 7/1985 Aujla ..... 339/17 LC

FOREIGN PATENT DOCUMENTS 1528076 4/1968 France ..... 339/17 LC

*Primary Examiner*—Gil Weidenfeld
*Assistant Examiner*—Gary F. Paumen
*Attorney, Agent, or Firm*—Bruce J. Wolstoncroft

[57] ABSTRACT

An electrical terminal assembly is provided with retention clip means for retaining a substrate in place. The retention clip means are designed in such a manner as to allow the insertion of the substrate into the clip means without damaging a sensitive layer of material provided on one side of the substrate.

7 Claims, 11 Drawing Figures

ELECTRICAL TERMINAL ASSEMBLY FOR THERMISTORS

FIELD OF THE INVENTION

The invention relates to an electrical terminal assembly with retention clips for securing substrates thereto. More particularly, it relates to an electrical terminal assembly with retention clips which are designed to move in such a manner as to prevent the senstive layer of the substrate, such as a thermistor, from being harmed during insertion of the substrate between the retention clips and the contact of the electrical terminal assembly. Once the substrate is fully inserted, the retention clips provide the normal force required to hold the substrate between the retention clips and the contacts.

BACKGROUND OF THE INVENTION

Many substrates, in the form of chips, are used for a wide variety of purposes. Many of these chips are provided with a relatively thin layer of sensitive material on one side. The sensitive material is the portion of the chip which performs the desired function, i.e. monitor temperature. The rest of the chip merely acts as a non-heat-conducting support for the sensitive material. An example of this type of configuration is found in the automotive industry where ceramic thermistor chips act as variable resistors to monitor engine coolant temperatures and air charged temperatures. These variable resistors are very accurate and very small, making them ideal thermistor layer is thin in comparison with the rest of the chip and therefore the thermistor layer can be easily damaged if handled improperly. Consequently, in order to avoid any unnecessary contact with the thermistor layer, termination of the thermistor chips, as well as all such chips, has become a time-consuming process, as only a small scratch, etc., can destroy the integrity of the thin layer of the chip, making the chip useless. Therefore, in order to ensure that the required characteristics are retained, termination of the chips has become very labor intensive.

Such labor intensive means of termination used in the automotive industry with respect to thermistor chips is to take two thermocouple wires and individually solder them to a temperature sensitive chip. The chip and wires are then twice overmolded to produce the finished product. This operation requires the handling of many discrete fragile parts and consequently requires a relatively large amount of time to complete, making this operation infeasible for robotic conversion.

SUMMARY OF THE INVENTION

The electrical terminal assembly of the present invention is for termination of a substrate and comprises electrical terminals having receptacle mating ends which cooperate with matable electrical terminals to electrically connect the terminals together. Opposite the receptacle mating ends are provided substrate receiving ends. The substrate receiving ends have retention clips provided with projections which cooperate with contacts to hold the substrate in place.

Insertion of the substrate between the retention clips and the contacts must be done in such a manner as to prevent harm to a sensitive resistive layer of material on one side of the substrate. Thus, the terminals are designed such that as the substrate is inserted, projections and the retention clips of the substrate receiving ends are displaced allowing the sensitive layer to be inserted past contacts of the substrate receiving ends with no excessive force being exerted by the contacts on the sensitive layer of the substrate.

An object of this invention is to provide an electrical terminal assembly which can quickly and easily terminate a substrate with a sensitive layer on one side thereof. This operation eliminates the labor intensive process currently used and replaces it with an operation which can be performed robotically, thereby drastically reducing the cost of operation.

DETAILED DESCRIPTION OF THE INVENTION

Figure 1:
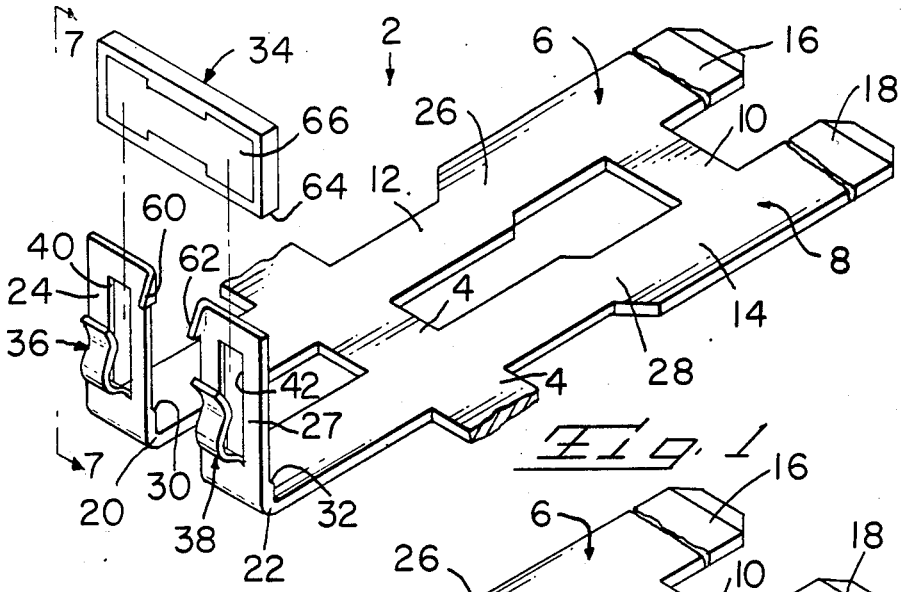
FIG. 1 is a perspective view of terminals of a connector of the invention with a substrate exploded therefrom.
Figure 2:
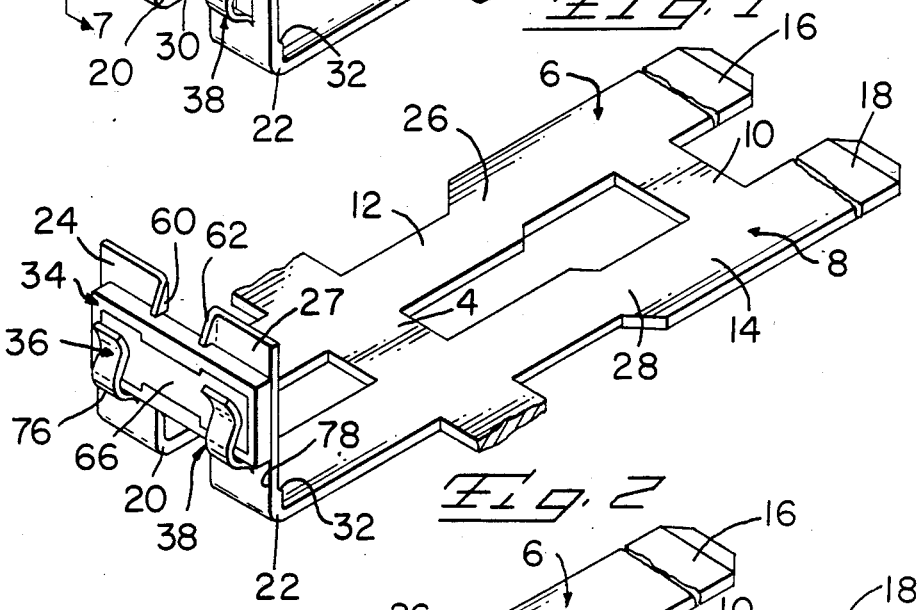
FIG. 2 is a perspective view of the terminals similar to FIG. 1 with the substrate inserted therein.
Figure 3:
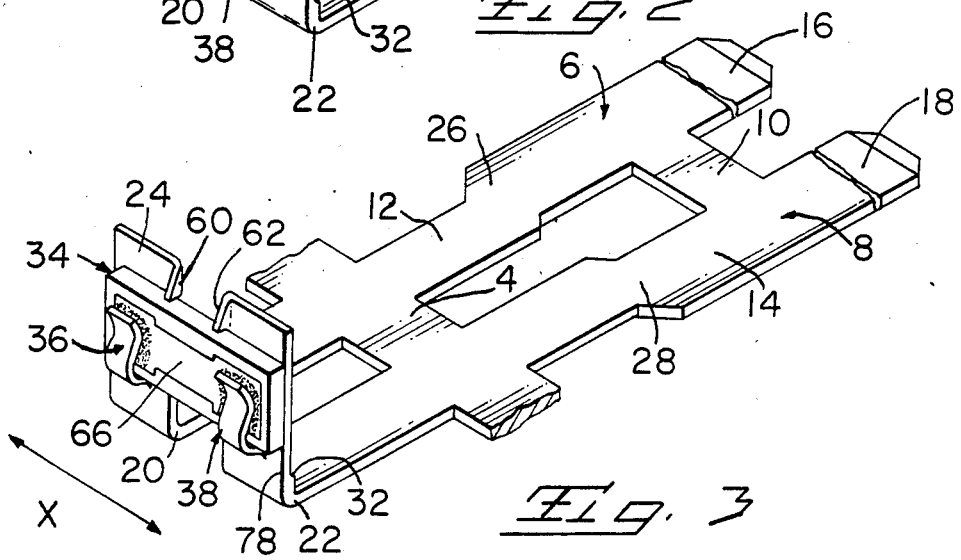
FIG. 3 is a perspective view similar to that of FIG. 2 showing the substrate soldered to the terminals.

An electrical terminal assembly 2, as shown in FIGS. 1 through 3, is stamped from a strip of sheet metal having the appropriate conductive and resilient characteristics, such as phosphor bronze. Terminal assemblies 2 are maintained in a continuous strip by carrier strip support 4 until such time as separation is required, as discussed below.

Electrical terminal assembly 2, as shown in FIGS. 1 through 3, has two terminals 6, 8. Terminals 6, 8 are mirror images of each other and are secured in a spaced-apart fashion by supports 4 and spacers 10.

Each terminal 6, 8 is provided with a base portion 12, 14 of a first thickness. A mating end 16, 18 is shaped to allow terminals 6, 8 to be inserted into a corresponding electrical receptacle (not shown). A bent end 20, 22 is provided opposite mating end 16, 18 and connects base portion 12, 14 to a retention clip 24, 27 as will be discussed. As both ends require a different spacing, a transition 26, 28 must be provided on base portion 12, 14. Transition 26, 28 is positioned between support 4 and spacer 10 and is designed to allow the spacing of mating ends 16, 18 to be greater than the spacing of bent ends 20, 22. It should be noted that although the above configuration is shown, the mating end can have many configurations, i.e. a pin, etc.

Retention clips 24, 27 extend from bent ends 20, 22. However, retention clips 24, 27 are of a less thickness than the thickness of base portions 12, 14 and mating ends 16, 18. Therefore, a transition 30, 32 is provided proximate bent end 20, 22. This is an important feature of this invention because retention clips 24, 27 must be thin so as not to act as a heat sink for a thermistor chip 34 which will be more fully discussed below.

Figure 7:
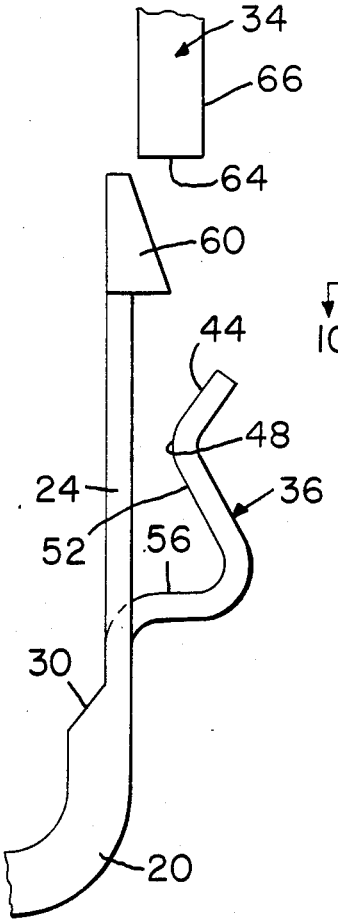
FIG. 7 is a side elevational view taken along line 7—7 of FIG. 1 showing the substrate and the terminals just prior to insertion of the substrate into the housing.
Figure 8:
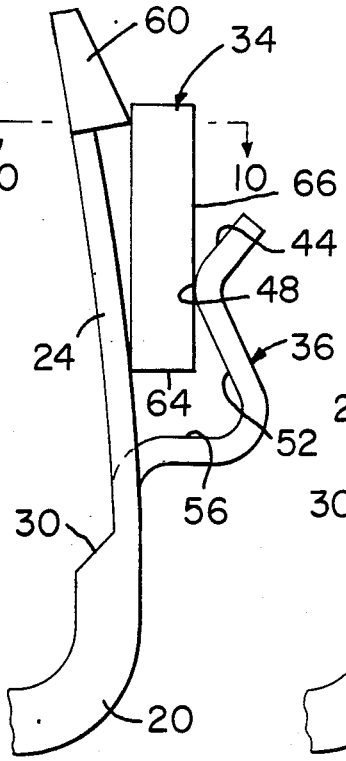
FIG. 8 is a view similar to that of FIG. 7 showing the substrate and terminals during insertion of the substrate into the terminals.
Figure 9:
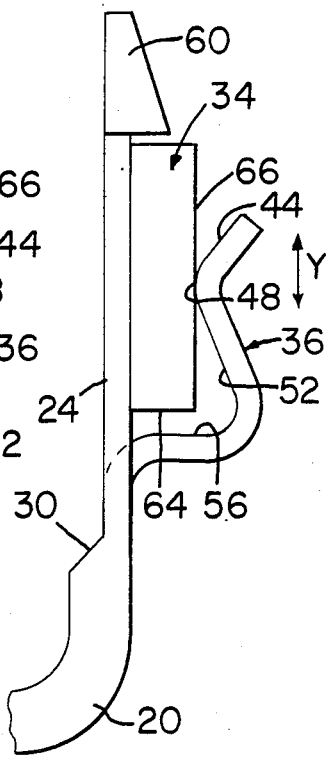
FIG. 9 is a view similar to that of FIG. 7 showing the substrate inserted into the terminals.

Retention clips 24, 27 are substantially perpendicular to base portions 12, 14. Contacts 36, 38 are stamped from retention clips 24, 27 respectively, leaving openings 40, 42 present therein. Contacts 36, 38 are then bent, as best shown in FIGS. 7 through 9, in the form of a generally S-shape configuration defining a chip guiding surface 44, a thermistor contact surface 48, a support surface 52, and a stop surface 56. These surfaces are important to ensure that proper insertion of the thermistor chips 34 takes place, as will be discussed. Referring back to FIGS. 1 through 4, each retention clip 24, 27 has a triangular projection 60, 62 extending from an upper inside corner in the direction of contacts 36, 38. Projections 60, 62 serve to retain thermistor chip 34 in place after insertion of thermistor chip 34 between retention chips 24, 26 and contacts 36, 38.

As mentioned above, terminals 6, 8 are stamped from the appropriate metal stock. Carrier strip supports 4 maintain terminals 6, 8 as terminal assemblies 2 in a continuous strip to facilitate automatic handling. Terminal assemblies 2 are moved to an insertion station where thermistor chips 34 are positioned above clip portions 24, 27 as shown in FIG. 1. Chips 34 are then inserted between retention clips 24, 27 and contacts 36, 38 (FIG. 2) under the control of robotic insertion equipment (not shown). To ensure proper positioning of chips 34 as insertion occurs, it is essential that the feed mechanism contain chips 34, allowing only motion in the downward direction.

Figure 10:
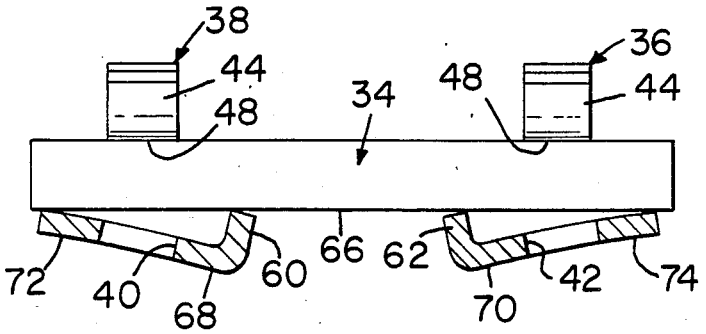
FIG. 10 is a cross-sectional view taken along line 10—10 of FIG. 8 showing the terminals and substrate during insertion.

FIGS. 7 through 10 show how insertion of chip 34 between retention clips 24, 27 and contacts 36, 38 takes place. FIG. 7 shows the identical position of chip 34 and retention clips 24, 27 as shown in FIG. 1. Upon insertion, a bottom 64 of chip 34 contacts a side of projections 60, 62, forcing projections 60, 62 and thin retention clips 24, 27 to the side. Further insertion causes bottom 64 of chip 34 to contact chip guiding surfaces 44 which guide chip 34 into proper alignment ensuring that no extreme forces will be placed on a thermistor layer 66 of chip 34 as it reaches contacts 36, 38. FIG. 8 shows chip 34 inserted such that bottom 64 is past surfaces 44. A top of retention clips 24, 27 and projections 60, 62 are caused to bend while contacts 36, 38 remain relatively stationary, allowing contacts 36, 38 to exert minimal force on thermistor layers 66 of chips 34, avoiding any damage to thermistor layers 66. FIG. 10 shows how retention clips 24, 27 twist as insertion occurs. Projections 60, 62 and sides 68, 70 of retention clips 24, 27 are displaced a much greater distance than sides 72, 74 of retention clips 24, 27. In other words, points 76, 78 of retention clips 24, 27 (FIG. 2) act as twisting pivot points, allowing the desired motion of retention clips 24, 27. As insertion is complete (FIG. 9), chip 34 is seated between stop surfaces 56 of contacts 36, 38 and projections 60, 62 which resiliently return to approximate their original position as chip 34 moves past them under the influence of retention chips 24, 27. Contact surfaces 48 of contacts 36, 38 are positioned against thermistor layers 66. Chip 34 is now prevented from moving in the Y direction shown in FIG. 9.

After chips 34 are inserted into terminals 6, 8, they are advanced to the next station where flow soldering takes place to secure chip 34 to contacts 36, 38 as well as insure positive electrical connection therebetween. As the carrier strip is being advanced to the flow soldering operation, the strip is turned upside-down. Contacts 36, 38 and retention clips 24, 27 exert enough force on chip 34 to retain chip 34 in the X direction (FIG. 3). Flow soldering takes place between thermistor layers 66 and contacts 36, 38. The strip is returned to its original position with the open ends of contacts 36, 38 on top. The flow soldered terminal is shown in FIG. 3.

Figure 4:
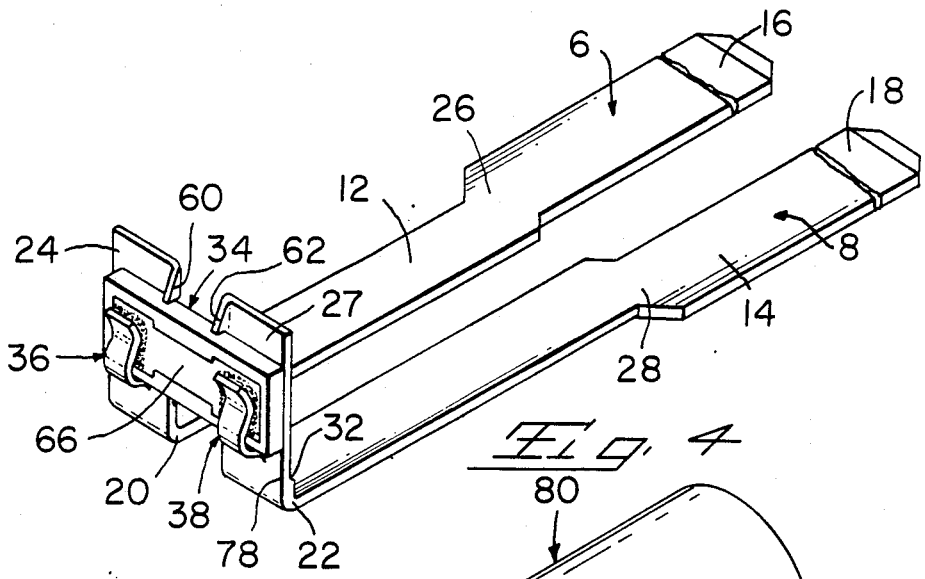
FIG. 4 is a perspective view of the terminals just prior to overmolding; spacing members have been removed.
Figure 5:
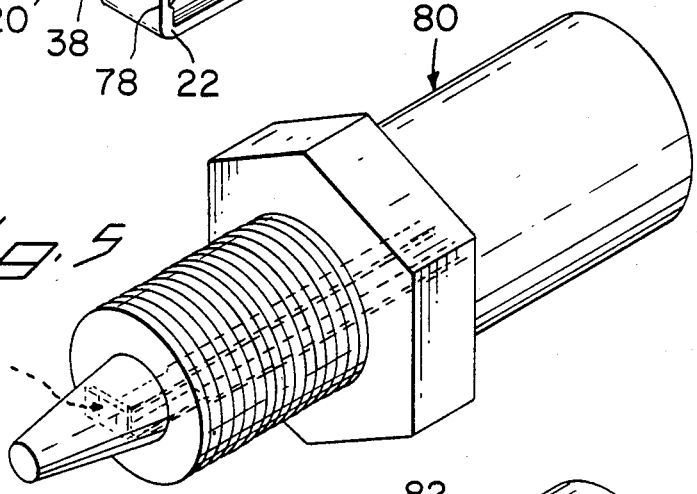
FIG. 5 is a perspective view of a housing overmolded onto the terminals of the connector.
Figure 6:
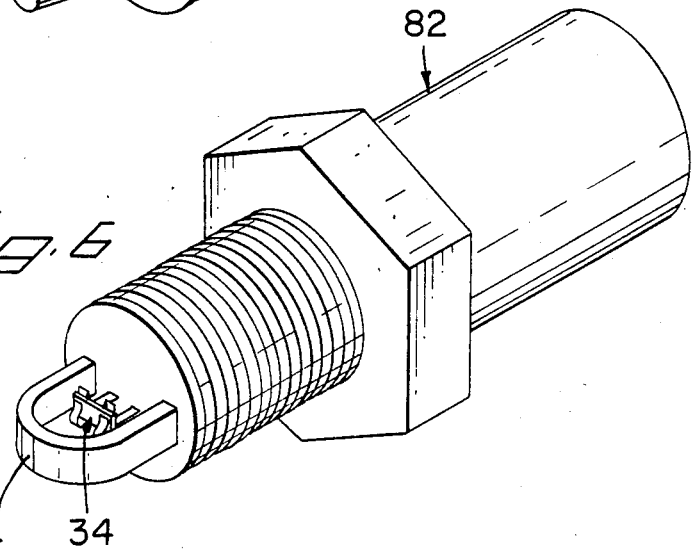
FIG. 6 is a perspective view similar to FIG. 5 showing an alternative housing.

Each terminal 6, 8 is held in place by an external device (not shown) as carrier strip support 4 and spacers 10 are removed from each terminal 6, 8, producing the terminals shown in FIG. 4. Overmolding of the connector then occurs. FIGS. 5 and 6 show two different housings 80, 82 which have been molded to terminals 6, 8. FIG. 5 is the type of housing 80 used when a liquid substance is to be monitored. Thermistor chip 34 is completely enclosed in a heat-conducting plastic to prevent corrosion/chemical attack of the terminals. As the temperature of the liquid changes, the temperature of the plastic housing changes correspondingly, enabling the thermister to accurately monitor the system. FIG. 6 shows a similar housing 82 as FIG. 5 with the end of the connector exposed, to be used when air temperature is to be monitored. Thermistor chip 34 is exposed to the air to more accurately monitor the system. The air does not harm the connector and thus this housing is preferred for air systems. A guard 84 is placed over chip 34 to prevent harm to chip 34 and the substrate-receiving ends of terminals 6, 8 from accidental contact.

Figure 11:
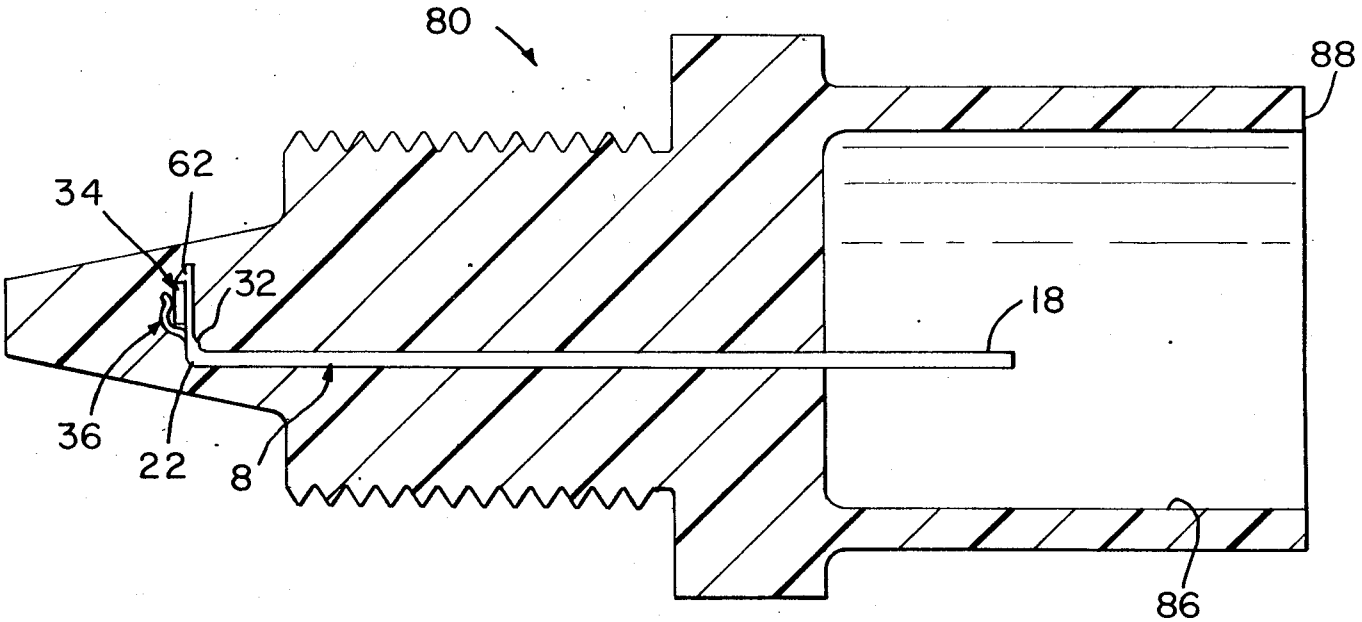
FIG. 11 is a cross-sectional view of the housing shown in FIG. 5.

FIG. 11 shows a cross-sectional view of terminal assembly 2 in housing 80 shown in FIG. 5. A cavity 86 is provided in the rear surface 88 of housing 80 so that mating ends 16, 18 of terminals 6, 8 can mate with the appropriate receptacle (not shown). Cavity 86 also serves to protect contacts 16, 18 from making accidental contact with other objects which would result in mechanical damage or electrical shorting of terminals 16, 18. The housing 82 shown in FIG. 6 would have the same cross-sectional view except the contact portion of each terminal and the chip would be exposed to the air and protected by the guard.

The unique design of terminal assembly 2 serves several important purposes. Retention clips 24, 27 allow insertion of the chip 34 without damaging the vital thermistor layers 66 of chips 34. The thickness of retention clips 24, 27 is such that they do not act as a heat sink for chips 34. A heat sink would make thermistor layer 66 ineffective at monitoring temperatures. The ease of handling and insertion enables terminal assembly 2 to be used for robotic handling, enabling fast, inexpensive, and reliable production of terminal assemblies 2 with chips 34 therein.

We claim:

1. An electrical terminal assembly for termination of a substrate, the electrical terminal assembly comprising:

terminal means having mating means and substrate receiving means, the mating means positioned at a respective end of the terminal means for mating with a corresponding connector, the substrate receiving means provided at an end of the terminal means opposite the mating means for receiving the substrate therein, the substrate having a thin, sensitive layer of material provided on one side thereof;

the substrate receiving means having base means, resilient securing means and contact means, the resilient securing means extending from the base means, the contact means extending from the base means in essentially the same direction as the resilient securing means but spaced from the resilient securing means a distance which is essentially equal to or slightly less than the width of the substrate to be inserted therebetween;

the resilient securing means having retention means provided thereon, the retention means projecting from the resilient securing means toward the contact means, the resilient securing means also having an intermediate portion which behaves similar to a twisting pivot point, the intermediate portion and the retention means being located at opposed ends of the resilient securing means;

the contact means having a contact surface which resiliently engages the thin, sensitive layer of the substrate when the substrate is fully inserted between the contact means and the resilient securing means, thereby insuring that the substrate and the electrical terminal assembly are in electrical engagement with each other;

whereby as the substrate is inserted into the substrate receiving means, the retention means are engaged, causing the resilient securing means to twist about the intermediate portion and thus move the retention means away from the contact means, allowing the substrate to be inserted between the contact means and the resilient securing means without causing the contact means to exert harmful stresses on the thin, sensitive layer of the substrate.

2. An electrical terminal assembly as recited in claim 1 wherein the retention means comprises triangular projections, whereby as the substrate in inserted into said substrate receiving means, each of said projections is resiliently moved to the side until the substrate engages stop surfaces at which time the substrate is free of the projections allowing the projections to return to their starting positions.

3. An electrical terminal assembly as recited in claim 1 wherein the base means has a transition means to enable the substrate receiving means and the mating means to be spaced accordingly.

4. An electrical terminal assembly as recited in claim 1 wherein the substrate receiving means has a smaller cross section than the rest of the terminal, preventing the substrate receiving means from acting as a heat sink for the substrate and more particularly to the sensitive layer on the substrate.

5. An electrical terminal assembly as recited in claim 1 wherein the terminal assembly is enclosed by a dielectric housing means having a recess provided at an end such that the terminal mating means can be positioned in the recess.

6. An electrical terminal assembly as recited in claim 5 wherein the retention means is enclosed by the housing means.

7. An electrical terminal assembly as recited in claim 5 wherein the retention means is exposed to the air, the housing means having a guard portion extending around the retention means to protect the retention means from accidental contact.

* * * * *